US005289659A

United States Patent [19]

Harrison

[11] Patent Number: 5,289,659

[45] Date of Patent: Mar. 1, 1994

[54] WINDOW AND DOOR ASSEMBLIES

[75] Inventor: Ian Harrison, Barnsley, United Kingdom

[73] Assignee: John Carr (Press Lock) Limited, South Yorkshire, United Kingdom

[21] Appl. No.: 777,341

[22] PCT Filed: Jun. 1, 1990

[86] PCT No.: PCT/GB90/00849

§ 371 Date: Dec. 5, 1991

§ 102(e) Date: Dec. 5, 1991

[87] PCT Pub. No.: WO90/15217

PCT Pub. Date: Dec. 13, 1990

[30] Foreign Application Priority Data

Jun. 8, 1989 [GB] United Kingdom ..... 8913226

[51] Int. Cl.[5] ..... E06B 3/00

[52] U.S. Cl. ..... 49/501; 49/504

[58] Field of Search ..... 49/504, 501, 400, 401

[56] References Cited

U.S. PATENT DOCUMENTS

| | | | |
|---|---|---|---|
| 1,245,018 | 10/1917 | Peribonis | 49/504 |
| 2,910,154 | 10/1959 | Hammitt et al. | 49/504 |
| 3,265,427 | 8/1966 | Williams | 49/504 |
| 3,449,883 | 7/1967 | Skubic et al. . | |
| 4,205,486 | 6/1980 | Guarnacci | 49/504 |
| 4,226,066 | 10/1980 | Persson | 49/504 |
| 4,982,530 | 1/1991 | Palmer | 49/504 |
| 5,035,085 | 7/1991 | Mamelson et al. | 49/504 |

FOREIGN PATENT DOCUMENTS

| | | |
|---|---|---|
| 1434248 | 12/1961 | Fed. Rep. of Germany . |
| 1683069 | 1/1966 | Fed. Rep. of Germany . |
| 54954 | 7/1943 | Netherlands . |
| 2132674 | 7/1984 | United Kingdom . |

*Primary Examiner*—Peter M. Cuomo
*Assistant Examiner*—Michael J. Milano
*Attorney, Agent, or Firm*—Fay, Sharpe, Beall, Fagan, Minnich & McKee

[57] ABSTRACT

A door or window assembly comprising a rigid first frame (1) defining an opening, and a second frame (9) adapted to be fitted into and close off the opening in the first frame (1), the first frame (1) being at least partly or wholly hollow and having a surface part with an opening (4) leading into a channel section (2) partly defined by side walls (6) of the said first frame (1), the second frame (9) including retaining means (12) of which a part can enter said channel section (2) through said opening (4) and thereafter securely engage the first frame (1) to prevent the second frame (9) from being withdrawn from the first frame (1). In a method of constructing a window or door assembly, the first frame (1) is incorporated within a building structure during construction thereof, the second frame (9) with or without an attached third frame (17) including retaining means (12) is offered up to the first frame (1) whereupon the retaining means (12) are actuated to securely affix the second frame (9) to the first frame (1).

4 Claims, 2 Drawing Sheets

WINDOW AND DOOR ASSEMBLIES

Figure 1:
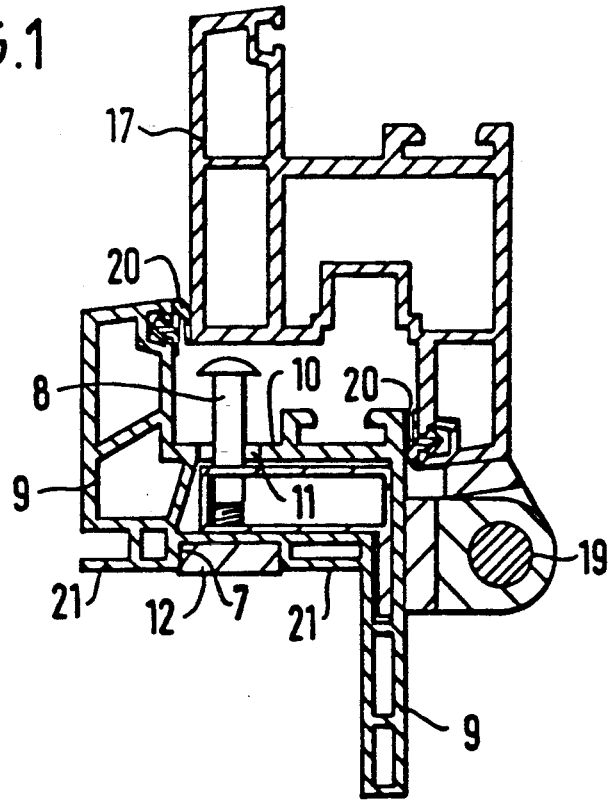

This invention is concerned with window and door assemblies. Conventional window assemblies as used for many years comprise a wooden or metal frame incorporated within a window aperture. Glazing is subsequently fitted into the frame and held in position by putty or the like.

The installation of such window frames is time consuming and requires skilled labour.

Conventional wooden doors are supported upon hinges which are directly attached to the frame work forming a door aperture and supporting the door in use. Heavy duty doors are costly and difficult to install and again generally require skilled labour.

It is from a consideration of existing window and door assemblies which has lead to the development of the present invention.

According to a first aspect of this invention there is provided a door or window assembly comprising a rigid first frame defining an opening, and a second frame adapted to be fitted into and close off the opening in the first frame, the first frame being at least partly or wholly hollow and having a surface part with an opening leading into a channel section partly defined by side walls of the said first frame, the second frame including retaining means of which a part can enter said channel section through said opening and thereafter securely engage the first frame to prevent the second frame from being withdrawn from the first frame.

According to a second aspect of this invention, a method of constructing a window or door assembly is provided in which a first frame is incorporated within a building structure during construction thereof, the second frame, with or without attached third frame, as defined above including retaining means is offered up to the first frame whereupon the retaining means are actuated to securely affix the second frame to the first frame.

The second frame can include a glazing unit or a door structure, preferably through the intermediary of a third frame. In this regard the first frame is most conveniently incorporated within the building structure during its erection. A ready-made door or glazing unit which is essentially complete can readily be applied to the first frame and subsequently secured thereto in a convenient manner which does not require skilled labour.

In the case of a door assembly such third frame is conveniently pivotally connected to the second frame. In the case of a window assembly the second frame may be pre-glazed and again easily inserted into the opening defined by the first frame whereafter the retaining means can be actuated to rigidly hold the second frame in position upon the first frame.

In a preferred construction retaining means comprises a bolt and anchor assembly. The anchor most conveniently is capable of resting within a recessed part of the second frame to be level with or flush with that surface of the second frame which is intended to be located adjacent that surface of the first frame which includes said opening. Accordingly the anchor may then be inserted through the opening, into the channel section and then caused to engage the side walls. Such an arrangement will become more apparent from the description of a preferred embodiment.

The first frame is preferably constructed from channel section having a surface part adapted to engage that surface part of a second frame which includes the recess, and which surface part is generally parallel with a base part adapted to engage the aperture within the building structure. The said channel frame can be securely mounted to the building structure within the appropriate aperture by means of ties and the like. It is convenient for the first frame to be substantially completely hollow and include generally parallel and upright side walls and/or depending lips which can engage a part of the retaining means.

Figure 2:
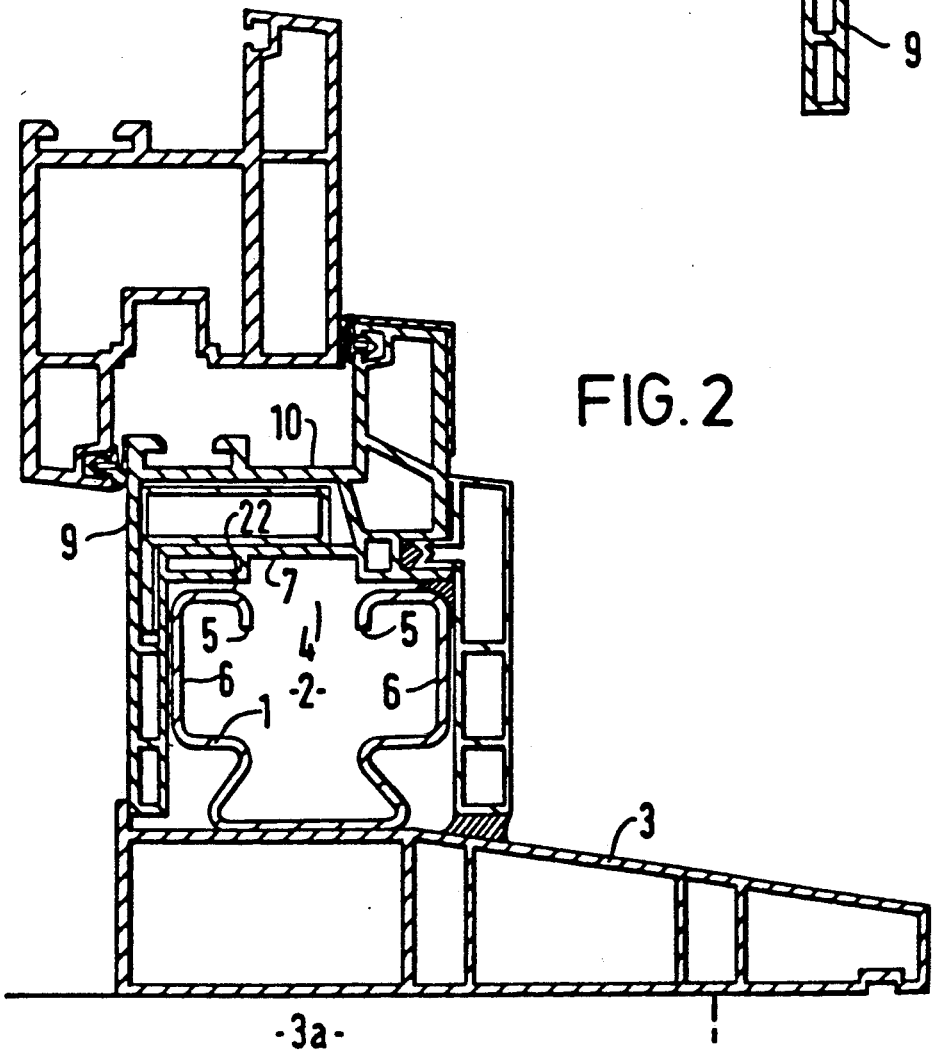
Figure 3:
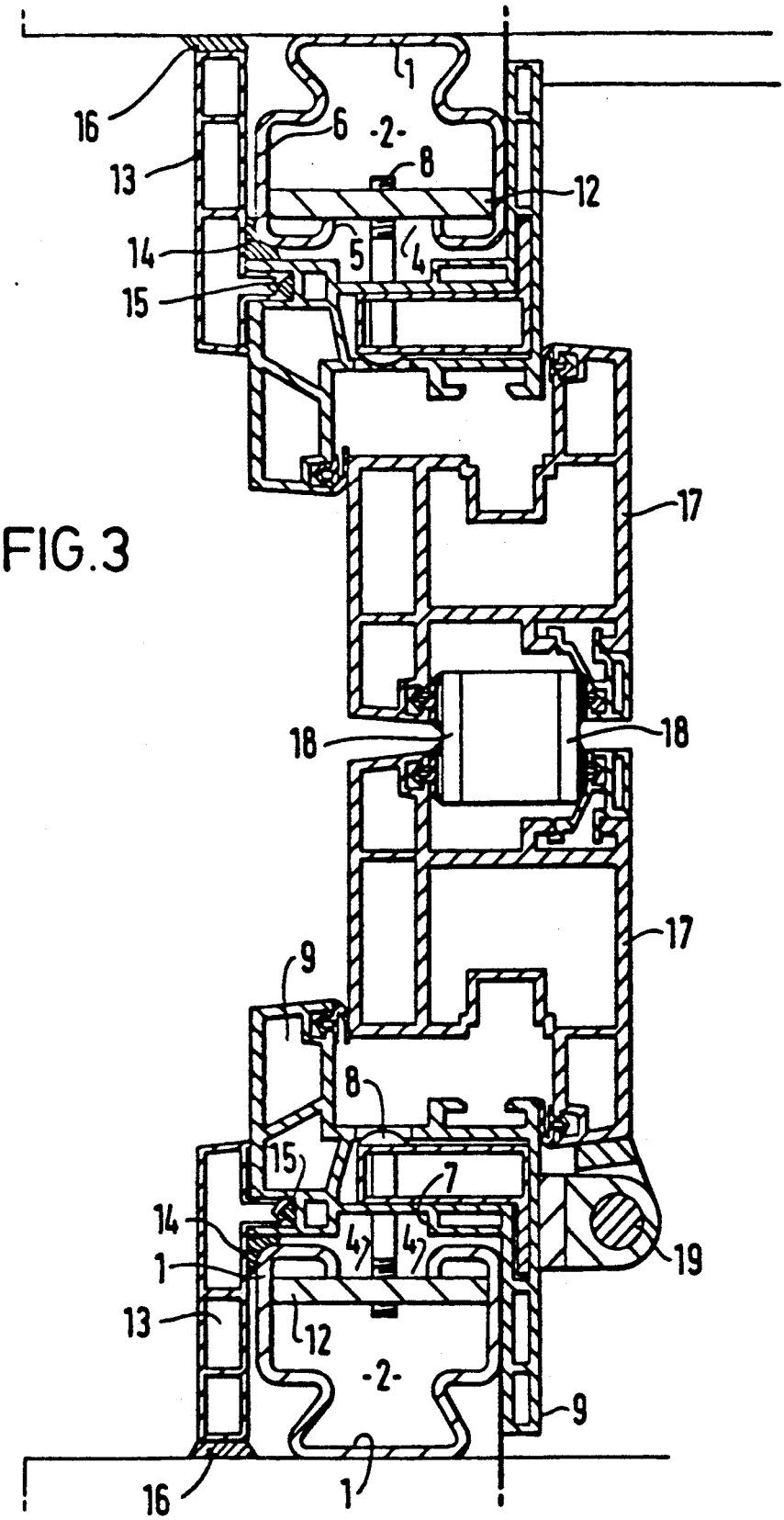

In order that the invention may be more readily understood, it will be now described by way of example only with reference to the accompanying drawings depicting a preferred embodiment and in which:

FIG. 1 is a vertical section through a second frame forming part of the assembly, to which a third frame is pivotally attached, FIG. 2 is a vertical section through a heavy duty window assembly comprising first and second generally rectangular four-limb frames, but retaining means being absent, and FIG. 3 is a vertical section through a rectangular door assembly according to the present invention.

Referring to FIGS. 1 and 2 of the drawings a second frame 9 has a surface part 21 capable of contacting a co-operating surface part (not shown) of a first frame. The said surface 21 is recessed at 7 wherein a retaining anchor 12 is located. The retaining anchor generally has straight sides and ends, which latter are capable of engaging the side walls (reference 6 in FIG. 2) of a first frame to prevent rotation and enable a bolt 8 to be tightened. The bolt 8, which may turned by, e.g. an allen key or the like, is threaded to engage a complementary thread in the anchor, and passes through an aperture 11 in an adjacent surface part 10 of the second frame 9.

A third frame 17 capable of carrying glazing (not shown) or a door assembly (not shown) is pivotally connected at 19 to second frame 9. Appropriate sealant or gasket strip 20 is located in the second and third frames to cushion the closure. When the third frame 17 is pivoted to one side, access is provided to at least the top of the bolt 8. Upon depressing the bolt the retaining anchor 12 is dislodged from its recess 7 and projects, via an opening 4, into the channel section part 2 of a first frame 1.

A horizontal section through one form of window assembly according to the invention is shown in FIG. 2 but wherein the retaining means are absent, only for clarity. It will be appreciated that the first frame 1, conveniently of galvanised steel construction, includes a rigid, generally rectangular part or section. Only one limb of the said first frame is depicted in cross-section. A sill 3 of PVC or like material can be incorporated within a building structure at the base 3*a* of a window aperture, during construction of that building. The first frame 1 can also be similarly included within the structure during construction work, the lowermost limb of the frame resting on the sill as shown in FIG. 2.

Prior to completion of the window and/or door assembly, apertures intended therefor may be pre-formed and pre-defined by the said first frame 1 in the building structure to greatly facilitate subsequent door and/or window assembly installation and securement by unskilled labour.

An opening 4 is formed in that surface 22 of the first frame 1 adapted to abut, with or without interposed sealant, the lower, horizontal surface 21 of the second frame. The said opening 4 leads into the hollow interior 2 of the first frame partly defined by side walls 6. Depending lips 5 form oppositely spaced flanges such that the anchor 12 can frictionally engage them to bring the second frame into tightened contact with the first frame.

Referring to FIG. 3 of the drawings there is shown in vertical a completed 'heavy duty' door assembly as part of a building. At each side of the building there are limbs 2 of the first frame 1 to which the second frame 9 has been rigidly secured. The first frame had already been incorporated into the building during construction whereafter the second frame was offered up to the aperture defined by the first frame from within the building. Note the second frame can be pre-attached to the third frame before offering up as a sub-assembly to the previously installed first frame. Once in position the anchor bolts 8 were tapped with a hammer or similar tool to release the locating anchor 12 from its recess 7 and permit it to project beyond the opening 4 in the steel frame 1 and into the hollow interior thereof. The anchor bolts 8 were appropriately tightened. Since the locating anchor was generally rectangular in shape and designed to trap its spaced ends across the internal width of the first frame i.e. within the channel section thereof. once it started to turn it started to self-tighten against the two side walls 6 of the first frame until its movement is stopped by the depending lips 5 forming flanges. In an alternative arrangement, the depending lips 5 can be absent.

Installation of such assemblies as described is quick and can avoid the need for skilled labour. A glazed frame or door frame can be fitted with trims 13 and appropriate sealant 14, 15, 16 to improve external appearance and/or form a water tight installation.

The apparatus is of primary use for constructing and installing residential doors, patio doors, and commercial inwardly opening windows. The present apparatus therefore enables the second frame (with or without pre-attached third frame), preferably of uPVC to be anchored to the first frame, preferably of galvanised steel, with the advantage of simplicity, speed of installation and avoidance of special tools.

It will be appreciated that the present apparatus may be useful where one or more limbs of the first frame includes an opening and channel section for penetration by retaining means.

Other embodiments of the invention are contemplated where at least one limb, such as that limb of the first frame adapted to abut or contact a sill does not include an opening or channel section as defined and illustrated above. One or more of the other limbs of said first frame will, in such embodiments, still include the opening and channel section whereupon retaining means can act to secure the second frame to those other limbs.

I claim:

1. A door or window assembly comprising a rigid first frame defining an opening, and a second frame selectively fitting into and closing off the opening in the first frame, the first frame having a surface part with an opening leading into a channel section partly defined by side walls of said first frame, the second frame including retaining means comprising a bolt and anchor part assembly, the anchor part selectively resting within a recessed part of the second frame to be level with or flush with a surface of the second frame that is selectively located adjacent the surface of the first frame which includes said opening, the anchor part selectively entering said channel section through said opening and the retaining means then being operated to securely engage the anchor part with the first frame to prevent the second frame from being withdrawn from the first frame wherein the second frame includes a glazing unit or door structure, carried by a third frame.

2. A door assembly as claimed in claim 1 wherein said third frame is pivotally connected to said second frame.

3. A method of constructing a window or door assembly comprising:

providing a rigid first frame defining an opening and a second frame selectively fitting into and closing off the opening, the second frame including a retaining means;

incorporation said first frame within a building structure during construction thereof;

fitting said second frame including said retaining means into the opening in the first frame;

attaching a third frame to said second frame before said step of fitting;

closing off the opening in the first frame; and, actuating the retaining means to securely affix the second frame to the first frame.

4. A door or window assembly comprising a rigid first frame defining an opening, and a second frame fitted into and closing off the opening defined by the first frame, the first frame being at least partly hollow and having a surface part with an opening leading into a channel section partly defined by side walls of said first frame, the second frame provided with retaining means comprising a bolt and anchor part assembly, and prior to actuation of said retaining means the anchor part resting within a recessed part of the second frame to be level with or flush with a surface of the second frame located adjacent the surface of the first frame which includes said opening, the anchor part being subsequently caused to enter said channel section through said opening and the retaining means then being operated to securely engage the anchor part with the first frame and thereby prevent the second frame from being withdrawn from the first frame, the second frame including a glazing unit or door structure carried by a third frame, and wherein said third frame is pivotally connected to said second frame.

* * * * *